United States Patent [19]

Caddell et al.

[11] 4,054,094

[45] Oct. 18, 1977

[54] LASER PRODUCTION OF LITHOGRAPHIC PRINTING PLATES

[75] Inventors: Jack R. Caddell, Landenberg, Pa.; Harvey H. Hoehn, Hockessin, Del.

[73] Assignee: E. I. Du Pont de Nemours and Company, Wilmington, Del.

[21] Appl. No.: 426,038

[22] Filed: Dec. 19, 1973

Related U.S. Application Data

[63] Continuation of Ser. No. 283,770, Aug. 25, 1972, abandoned.

[51] Int. Cl.[2] ..... B41C 1/10; B41M 5/24; B41N 1/14

[52] U.S. Cl. ..... 101/467; 101/455; 346/76 L

[58] Field of Search ..... 101/462, 455, 465, 466; 346/76 L

[56] References Cited

U.S. PATENT DOCUMENTS

| | | | |
|---|---|---|---|
| 2,311,047 | 2/1943 | Hagelin | 101/455 |
| 2,714,066 | 7/1955 | Jewett et al. | 101/467 X |
| 3,016,823 | 1/1962 | Thurlow | 101/466 X |
| 3,064,562 | 11/1962 | Deal | 101/465 X |
| 3,470,013 | 9/1969 | Wagner | 101/455 X |
| 3,506,779 | 4/1970 | Brown et al. | 178/6.6 |
| 3,560,994 | 2/1971 | Wolfe et al. | 346/135 |
| 3,574,657 | 4/1971 | Burnett | 96/36.3 |
| 3,650,742 | 3/1972 | Etter et al. | 101/467 X |
| 3,650,743 | 3/1972 | Hallman et al. | 101/467 X |
| 3,773,514 | 11/1973 | Fromson | 96/36 |

*Primary Examiner*—Clyde I. Coughenour

[57] ABSTRACT

The use of a laser beam to etch the surface of a printing plate made from a polymer composition on a metal or plastic base and a thin top coating of a hard hydrophilic material produces a lithographic printing plate capable of accepting ink in the etched region and accepting water in the unetched regions.

1 Claim, 7 Drawing Figures

LASER PRODUCTION OF LITHOGRAPHIC PRINTING PLATES

CROSS-REFERENCE TO RELATED APPLICATIONS

This application is a continuation of U.S. application Ser. No. 283,770, filed on Aug. 25, 1972 now abandoned.

BACKGROUND OF THE INVENTION

This invention relates to lithographic printing plates and to a method for their production. More specifically, it relates to lithographic printing plates made from organic polymeric compositions either alone or in combination with a metal or a polymer base, More specifically still, it relates to the production of printing plates made from a metal and an organic polymeric composition by engraving the polymeric surface of the printing plate with a focused laser beam.

Lithography, in contrast to letter-press printing from raised surfaces bearing ink or gravure printing from depressions containing ink, is the process of printing from surfaces that are essentially flat. The contrast between the image and background is not dependent on a difference in height between the two portions of the plate, but rather on their differing ability to accept ink or water. Lithographic plate making, then, is the process of forming an imge or design on a plate which will take a greasy ink, and treating the other non-imaging areas of the plate so that they will take water and, when moist, will refuse ink.

Lithographic plates come in a variety of forms, from etched, metal plates to type embossed paper and plastic mimeograph sheets, and the processes for producing these plates are as varied as their form. Photolithographic plates, however, consisting of a metal base and a thin coating of a light sensitive organic polymerizable material, are closest in kind to the present invention. In photolithography, a metal plate, often an aluminum plate, which accepts water, is coated with a light sensitive, unpolymerized, organic composition, such as a diazo compound, an azido compound or a photopolymerizable polymer which will polymerize upon exposure to light, and which, in its hardened state, will accept ink and reject water. The surface of the plate is exposed to light through a negative or a mask and that portion of the surface exposed to the light hardens. The other unpolymerized portions can be washed off the surface of the plate by some suitable solvent. In use, the plate is usually first moistened with water, so that when the ink is applied to the plate, the ink will be rejected by the metal and accepted by the polymerized coating which is not readily wetted by water. The ink may then be transferred directly or by offset to the surface to be imaged or printed.

Such plates are durable enough to be useful in moderately long printing runs and are reasonably inexpensive. One of their failings, however, is the fact that the imaged portions of such plates usually account for only a small portion of their surface. The larger metal, non-imaged portions will rub on the inking and transfer rollers and cause rapid wear to these parts. To avoid this, lithographic plates are often made from materials such as copper, which have been found to accept ink, and coatings which will accept water instead of ink. The background region is then polymerized and the image area washed away. The ink is accepted by the metal base and rejected by the moist polymer. Once again printing is by direct or ofset transfer, but because the majority of the surface of the plate is plastic, not metal, less wear on the rollers is experienced. The plates themselves, however, are no more durable than those made from aluminum, and are more expensive because copper has been substituted for aluminum.

The system described above is quite versatile. By judicious selection of the materials used, both positive and negative plates can be produced, and photographic production of the plates is faster and less expensive than hand production. There is room for improvement, however. For one thing, the use of a metal base plate, especially one made from copper is expensive, so there is a need for plates made entirely from plastic, or ones made with inexpensive metals such a aluminum. In the second plate, photolithography requires plates which must be kept unexposed during storage and which, for use on a commercial scale, requires massive and expensive equipment for photoimaging and developing. There is need for a simpler system. Finally, in those instances where the information to be imaged on the plate is in the form of electronic impulses, the conversion of these impulses to photographic negatives prior to the formation of the printing plates is an expensive and time consuming step. There is need for a system to directly convert such electronic signals into lithographic printing plates.

It is an object of the present invention, therefore, to provide a process for producing lithographic printing plates by other than photopolymerization. It is a further object of the present invention to provide a process for the production of lithographic plates which is less expensive than that presently in use. It is a still further object of the present invention to provide a process for the formation of lithographic plates directly from electronic impulses.

SUMMARY OF THE INVENTION

These objects are accomplished by subjecting the surface of a plate composed of an organic polymeric composition to a focused laser beam of sufficient intensity to decompose the polymeric composition and form an etched or depressed region in its surface, and varying, in a controlled manner, the point at which the laser beam impinges on the surface of the plate to form a predetermined pattern on the plate. In one embodiment, the plate is made entirely of a polymeric composition which will accept ink but not water, and the entire surface of the plate is coated with a hydrophilic topcoating, such as polysilicic acid, which will wet with water. When the laser etches the surface, it removes the hydrophilic surface in those areas which it strikes, and makes the resulting image receptive to ink. In this way, a lithographic printing plate made entirely from plastic can be formed. In another embodiment, a metal plate made from a material like aluminum, which is high enough in the electromotive series to accept water, is coated with an organic polymeric composition, preferably one which will not volatilize as it decomposes. The polymeric surface of the plate is then subjected to a focused laser beam of sufficient intensity to burn away the polymeric coating, and the point at which the laser beam impinges on the polymeric surface is varied in a controlled manner to form a predetermined pattern in the plate. While initially the metal base would accept water and not ink, the action of the laser on the surface of the metal plate in the presence of the decomposing polymeric composition converts the surface of the metal to a surface which will reject water and accept ink. A coating of polysilicic acid on the surface of the polymer then produces a lithographic printing plate containing a metal other than copper, which will wet with ink only in the image area and which has a surface primarily composed of a non-metallic hydrophilic material. In most cases, it doesn't matter whether the polysilicic acid coating is put on the polymeric coating before or after the laser etching. If the polymeric composition is one which, like Delrin* acetal resin, which is ether "end-capped" polyoxymethylene, decomposes to volatile products, however, the conversion of the metal surface will not occur, presumably because of the absence of non-volatile decomposition products, unless the polysilicic acid coating is placed on the surface of the polymeric composition before the laser etching. The presence of this coating appears to slow down the decomposition of the polymer so that conversion of the metal surface can occur. *Registered trademark of the E. I. du Pont de Nemours & Co.

It is well known that a laser beam can be used to etch the surface of a plate, particularly one having a polymeric surface, to form a printing plate. One of the inventors of the present invention has described such a process in U.S. Pat. No. 3,549,733. The disclosure in that patent, the specification of which is specifically incorporated herein, includes the concepts of forming depressions in plastic plates and etching away the plastic coating from a metal backing plate, and, as such, is similar to the present invention. In particular, the details of the mechanical and electrical mechanisms used to drive the laser beam in that patent are useful to drive the laser beam in the present invention. To a certain extent, however, the laser system used in the present invention is simpler than that set forth in the above-identified patent in that variations in the intensity of the laser beam to cause variations in the depth of the depression are not necessary. This simplification points to the distinction between the prior art and the present invention. The prior art deals with the ability of a laser beam to form depressions of various depth in the surface of a polymeric printing plate, while the present invention deals with the effect of the laser beam on the surface it strikes, particularly with the effect of the laser beam on the water attracting properties of that surface.

For a better understanding of the present invention, reference is made to the following figures.

DISCUSSION OF THE DRAWINGS

Figure 1:
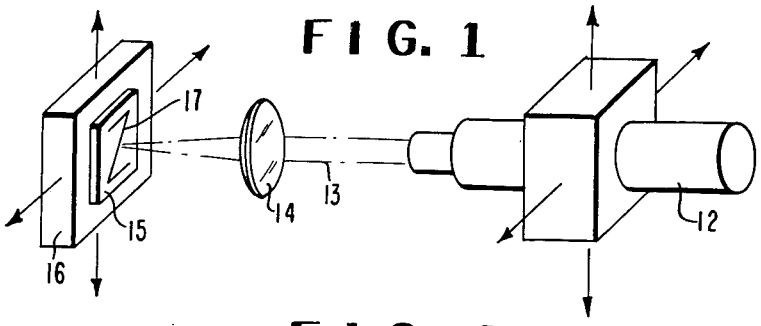
FIG. 1 is a schematic diagram of one possible embodiment of an apparatus that can be used to produce a printing plate.

In FIG. 1, laser 12 produces a beam of coherent radiation 13 which is focused by lens 14 onto the surface of plate 15 which rests on support stage 16. Either the laser or the support stage can be adapted to move in a controlled manner so that the beam of focused radiation can be made to trace the desired pattern on the surface of the sample plate.

Figure 2:
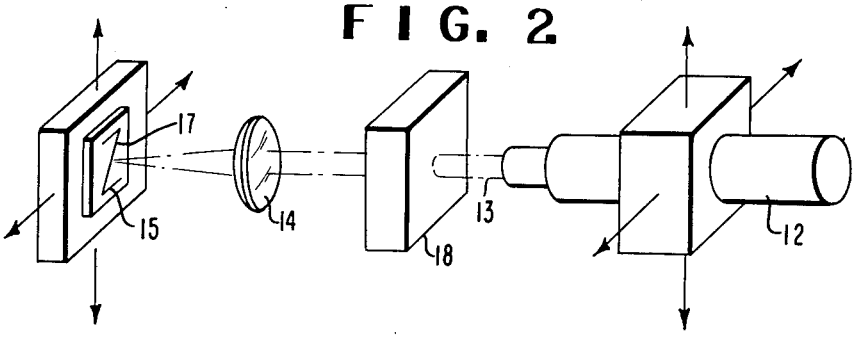
FIG. 2 is a schematic diagram of another possible embodiment of an apparatus that can be used to produce a printing plate.

The choice of laser depends largely on the necessary energy content or intensity of the beam. Almost any solid state, liquid or gaseous laser can be used. The $CO_2$ laser is particularly suitable because of its high level of efficiency and its high intensity output. The laser can be adapted to emit either a pulsed or continuous wave (CW) beam. If the laser emits a CW beam, the energy incident on a particular portion of the sample can be varied to suit the needs of the particular sample by either varying the output of the laser, or by varying the rate at which the laser beam moves relative to the sample. For many types of lasers, however, high intensity output is not possible under CW operation. Such lasers are often operated in a pulsed mode. Even if a laser capable of CW operation is used, a pulsed beam may be desirable to produce the dot patterns so often used in printing. Such a beam can be produced by chopping the laser beam with a chopping device 18 placed between the laser and the plate as shown in FIG. 2. This chopper can be a slotted rotating disc, a Kerr cell, or any other chopping device known to those skilled in the art. Alternatively, the laser itself can be pulsed by a method such as Q-switching. If a pulsed beam is used, the energy incident on a particular portion of the sample can be varied by varying the output of the laser, the rate and duration of the pulse, or the rate at which the laser beam moves relative to the sample. The particular details of the laser light source are not given since these sources are well known to those skilled in the art. One suitable laser is Model 40 $CO_2$ gas laser manufactured by Coherent Radiation Laboratories.

Lens 14 is illustrated as a refracting lens. It should be apparent, however, that a reflecting and focusing mirror could be used in place of the lens if desired. In any event, the focusing device can be of either fixed or variable focus. If a lens is used, the lens must be transparent to the wavelength of the laser beam, otherwise absorbed energy will cause discoloration and perhaps cracking of the lens material. One suitable lens for use with the laser designated above is Model LS-20 (2½ inch effective focal length) made by Coherent Radiation Laboratories.

Figure 3:
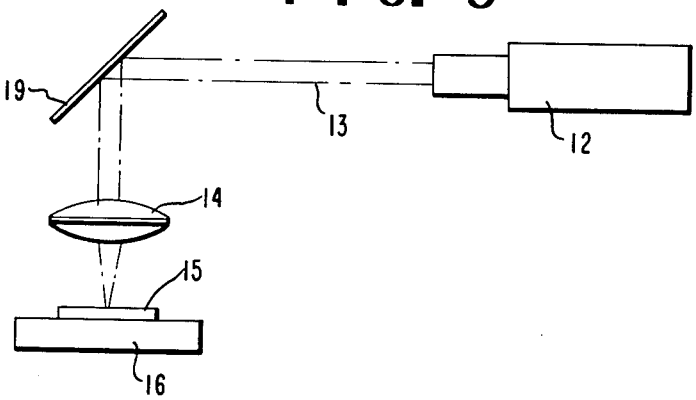
FIG. 3 is a schematic diagram of a third possible embodiment of an apparatus, including scanning means, which can be used to produce a printing plate.

The pattern 17 can be produced in numerous ways. As shown in FIGS. 1 and 2 the laser can be stationary and the plate 15 can be mounted on a movable stage which is programmed to execute the movement necessary to trace out the desired pattern. Alternatively, the surface can be immobile, and the laser and associated focusing lenses can be moved. In many instances, however, movement of such bulky structures is not feasible or rapid enough, so both the laser and the plate are held stationary, and the laser beam is deflected by using a mirror 19 as shown in FIG. 3. The mirror can be of almost any material which will withstand the intense laser beam; such as polished stainless steel, front surface coated silicon, or front surface coated germanium. One suitable mirror is Model RT-00 made by Coherent Radiation Laboratories. A single mirror with two degrees of rotational freedom can be used so that the laser beam can be moved at will across the surface of the plate. Alternatively, two mirrors with a single degree of rotational freedom apiece can be used, or a single mirror with a single degree of freedom can be used in conjunction with a moving sample stage. Instead of moving the laser beam in a path reproduction of the pattern to be transferred, the laser could be made to scan the entire plate, or a portion of it in much the same way that a television raster is produced. By modulating the laser beam as it scans the plate, a pattern could be formed in the desired areas so that a predetermined trace or picture could be reproduced.

Figure 4:
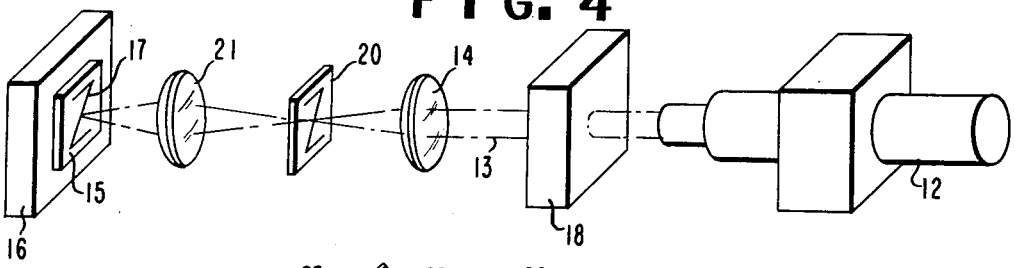
FIG. 4 is a schematic diagram of a fourth possible embodiment of an apparatus which can be used to reproduce the image of a template or transparency on a printing plate.
Figure 5:
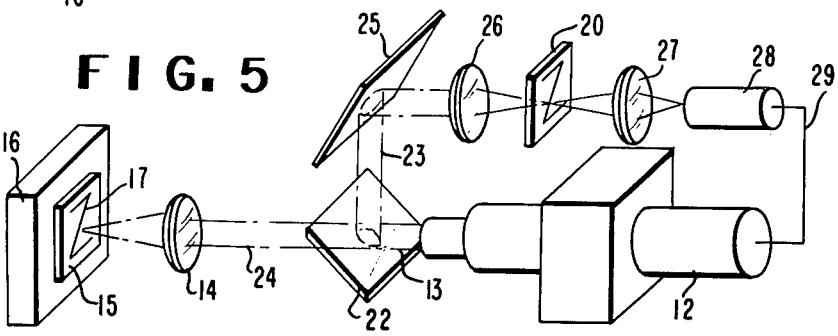
FIG. 5 is a schematic diagram of a fifth possible embodiment of an apparatus which can be used to reproduce the image of a template or transparency on a printing plate.

Modulation of the laser beam can be accomplished in a variety of ways. The output of the laser could be varied in much the same way that the electron beam in a television tube is modulated, so that in effect a picture could be traced on the plate utilizing the same type of information that goes into a television receiving set. A simpler way to achieve the same result would be to keep the output of the laser constant and modulate the beam by placing a mask, 20, between the laser and the sample, as shown in FIG. 4. Some suitable imaging devices such as lens 14 and 21 would be required, but in any event the pattern transferred to the plate would correspond to the transparent areas of the mask. Such a mask can be either a template, with openings reproducing the desired image, or a filter where the intensity of the laser beam striking the sample is controlled by the optical density of the filter. To achieve high resolution such a mask would have to be placed in a focused portion of the beam, such as between lens 14 and 21 as illustrated in FIG. 4. Since the laser beam has the capacity to burn through many materials, such a mask would have to be constructed from material which would be effectively impervious to the laser beam during the period of its use. This places serious restriction on the type of material from which the mask can be made. Another way to use the laser to reproduce the image on a mask, be it either a template or a filter, would be to use an apparatus such as that shown in FIG. 5. In FIG. 5 the laser beam 13 strikes a semi-transparent mirror 22 placed in an unfocused portion of the beam. The semi-transparent mirror is constructed so that only a small portion of the beam 23 is deflected from the main path and the major portion of the beam 24 is available to be focused through lens 14 to be used in imaging the plate 15. The deflected portion of the laser beam 3 can be directed at the template 20, either directly or through deflecting mirrors, such as mirror 25. The light passing through the template is incident on a light detecting means 28, the output of which can be used to modulate the laser beam. This modulation can be accomplished by a feedback loop such as that indicated by lead 29. Alternatively the feedback loop can be connected to a chopping device, such as that discussed above in connection with FIG. 4, placed between the semi-transparent mirror 22 and lens 14. Light detecting means 28 can be a photocell or any other suitable device, and the components of the feedback circuit can be of any type known to those skilled in the art. Since the deflecting beam is unfocused, for high resolution, some sort of focusing system such as that provided by lens 26 and 27 is necessary. In this case, since only a small portion of the laser beam is being utilized, masks which would ordinarily be destroyed by the full laser beam can be employed. As in FIG. 4 such a mask can be either a template or a filter, and the filter can be a photographic transparency. The template would be effective in the case of moderately simple black and white designs. A simple transparency would suffice for black and white photographs. Three or four transparencies would be required to produce the three or four printing plates required if color printing is contemplated.

Figure 6:
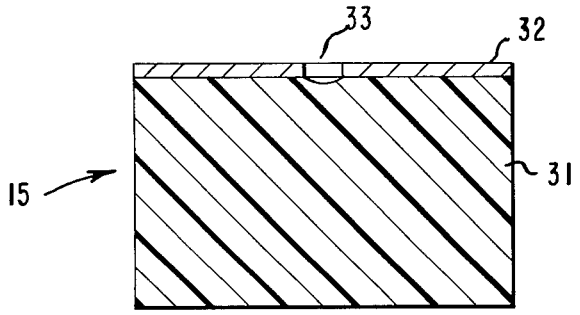
FIG. 6 is a cross-section diagram of one type of lithographic plate that a device such as that of FIG. 1 will produce.
Figure 7:
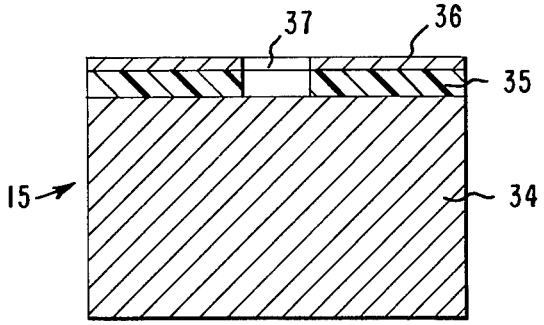
FIG. 7 is a cross-section diagram of another type of lithographic plate that a device such as that of FIG. 1. will produce.

All of the above techniques can be used to transfer an image to any convenient shape. In all of the discussion, the surface is referred to as a plate such as that shown in FIGS. 6 and 7 which connotes flatness, but the term is used in the sense of a printing plate which can include cylindrical surfaces or surfaces of almost any shape. In FIG. 6, the plate 15 is composed of a polymeric composition 31 with a thin coating of a hard hydrophilic material 32 on the surface. The laser etches a trace 33 which burns off the thin coating and alters the surface structure of the plate, possibly by burning a short distance into the polymer. In FIG. 7, the plate 15 has a metal base 34, a thin coating of a polymer 35 on the surface of the metal and a thin coating of a hard hydrophilic material 36 on the exposed surface of the polymer. The laser etches a trace 37 which burns away both coatings down to the metal. Examples of the organic polymeric compositions which may be used either for the base plate or for the thin coating over the base plate in this invention include: polyacetals, such a polyoxyethylene (which is normally ether "end-capped" for stability); polyesters, such as polyethyene terephthalate; acrylic polymers, such as polymethyl methacrylate and copolymers of methyl methacrylate with other polymerizable monomers (e.g., 90% methyl methacrylate and 10% ethyl acrylate); polyamides, such as poly(hexamethylene adipamide); polyethylene; polychloral; and fluorocarbon polymers and copolymers (e.g., copolymers of tetrafluoroethylene with hexafluoropropylene). It has also been found that essentially the same result as obtained with the specifically constructed composite plates discussed above can be obtained by using commercially available composite photoresist plates of similar composition.

The metal plates may be made from metals such as aluminum, chromium, copper, stainless steel, galvanized steel, steel, brass and Monel®.

The critical feature of the present invention, then, is not the shape of the surface or the type of laser system used byt rather the surfaces employed and the effect of the laser on those surfaces, as can be seen from the following Table and Examples:

TABLE

| BASE | | | | | |
|---|---|---|---|---|---|
| Al | Cr | Cu | Mylar® | BASE COATING | SURFACE COATING |
| — | — | — | $A_{(a)}$ | None | None |
| $A_{11}$ | $A_{14}$ | — | — | Mylar® | None |
| $A_{12}$ | $A_{15}$ | $A_7$ | — | Mylar® | 1% PSA |
| $A_{13}$ | $A_{16}$ | $A_8$ | — | Mylar® | 3% PSA |
| $R_{20}$ | — | — | — | Delrin® | None |
| $A_{21}$ | — | — | — | Delrin® | 1% PSA |
| $A_{22}$ | — | — | — | Delrin® | 3% PSA |

TABLE-continued

| BASE | | | | BASE COATING | SURFACE COATING |
|---|---|---|---|---|---|
| Al | Cr | Cu | Mylar® | | |
| $A_{17}$ | — | — | — | Methyl Methacrylate | None |
| $A_{18}$ | — | $A_9$ | $A_3$ | Methyl Methacrylate | 1% PSA |
| $A_{19}$ | — | $A_{10}$ | $A_4$ | Methyl Methacrylate | 3% PSA |
| $R_{(b)}$ | $R_{(d)}$ | $A_5$ | $A_1$ | None | 1% PSA |
| $R_{(c)}$ | $R_{(e)}$ | $A_6$ | $A_2$ | None | 3% PSA |

A - Etched area accepts ink
R - Etched area rejects ink
subscripts - example numbers

EXAMPLE 1-4

In one embodiment of the present invention, the surface of a plate made entirely from an organic polymeric material is coated with a thin coating of a hard hydrophilic material such as polysilicic acid (PSA) and the laser is used to burn off the coating in those regions containing the pattern. The unetched surface of the plate accepts water and rejects ink, while the etched surface rejects water and accepts ink. The action of the laser on the polymeric surface does not affect the characteristic of the surface to reject water, so the laser could be used to etch the surface prior to the coating with polysilicic acid, using the laser merely to lower the level of the surface so that a coating of polysilicic acid can be applied to the other portion of the surface.

As a control (a), a plate made from "mylar"* polyester was etched with the laser beam without affecting the ability of the entire surface to reject water and accept ink. In Examples 1 and 2, the plate of Mylar® was surface coated with a 1% and a 3% solution of polysilicic acid, respectively, and the laser was used to etch the surface. The plate accepted water in the unetched areas but rejected water and accepted ink in the etched areas. Examples 3 and 4 are the same as Examples 1 and 2 except that the Mylar® base of polysilicic acid was coated with polymerized methyl methacrylate before the surface coating was applied. The same results were achieved.

* Registered trademark of E. I. du Pont de Nemours and Company

EXAMPLES 5 and 6

In a second embodiment of the present invention, a thin coating of a hard hydrophilic material such as polysilicic acid is placed on a metal low enough in the electromotive series so that it will reject water and accept ink, and a laser is used to burn away the coating in the imaging regions. In Examples 5 and 6 1% and 3% solution of PSA, respectively, are used to coat a copper plate, and the region etched by the laser were found to reject water and accept ink, while the other portions accepted water.

EXAMPLES 7-10

In a third embodiment of the present invention, a base made from a metal low enough in the electromotive series so that it will reject water and accept ink was coated with an organic polymer and then surface coated with a thin coating of a hard hydrophilic material such as polysilicic acid. The surface was then etched down to the metal with a laser beam. The ability of the metal to reject water and accept ink was unaffected. In Examples 7 and 8, a copper plate was first coated with Mylar® and then 1% and 3% solutions of polysilicic acid, respectively. The unetched portion of the plate accepted water and the etched portion rejected water and accepted ink. Examples 9 and 10 are the same as Examples 7 and 8 except that the base coating was polymerized methyl methacrylate rather than Mylar®.

EXAMPLES 11-22

In a fourth embodiment of the present invention, a plate made from a metal high enough in the electromotive series to accept water is coated with a thin coating of an organic polymer material, and a thin coating of a hard hydrophilic material such as PSA, and the coatings are etched down to the metal with a laser. The metal which normally accepts water now rejects water and accepts ink, while the other portion of the surface of the plate accepts water. For most polymeric coatings it doesn't matter whether the PSA is put on before or after laser etching, but for some polymers, like Delrin® which decomposes to volatile byproducts under the action of the laser, the surface transformation of the metal only occurs after the PSA is on the surface during etching. The reason for this is not well understood, but it is felt that the presence of the PSA inhibits volatilization of the polymer byproducts which contributes to the conditioning of the metal surface.

In Example 11, an aluminum plate, which normally accepts water, was coated with Mylar® and etched with a laser. The portion of the plate etched with the laser, as well as the Mylar® coating rejected water and accepted ink. To make an effective printing plate from this structure, the unetched portions of the plate should be coated with polysilicic acid. In Examples 12 and 13, a thin coating of a 1% and 3% solution of polysilicic acid, respectively, was placed on the exposed surface of the Mylar® coated aluminum based. The plate was etched by a laser down to the metal. The unetched portion of the plate accepted water while the etched portion did not. Examples 14 through 16 are the same as Examples 11 through 13, respectively, except that the metal base is made from chromium instead of aluminum. The same results are obtained. Examples 17 through 19 are the same as Examples 11 through 13, respectively, except that the base coating is polymerized methyl methacrylate instead of Mylar®.

In Examples 20 through 22, the metal base is aluminum and the base coating is Delrin®, a polymer that decomposes to volatile byproducts. As can be seen from Example 20, without the polysilicic acid coating, the laser acting on the polymer coated plate will not transform the surface of the aluminum from a water accepting to a water rejecting surface. As can be seen by Examples 21 and 22, however, with the polysilicic acid coating, the surface is transformed.

As controls (*b*) and (*c*), thin coatings of 1% and 3% solution of polysilicic acid are applied directly to an aluminum plate. Without the polymer between them, the action of the laser on the coated plate does not transform the surface from a water accepting to a water rejecting surface. Controls (*d*) and (*e*) are the same as controls (*b*) and (*c*), respectively, except that the matal base is chromium instead of aluminum.

What is claimed is:

1. A process for making a lithographic printing plate, the imaging portion of which comprises a metallic surface which comprises the steps of:

a. providing a plate comprising an aluminum base, a thin coating of an organic polymeric composition comprising materials selected from the group conisting of polyester, polymethyl methacrylate and polyoxymethylene, disposed on one surface of said aluminum base, and a thin coating of poly silicic acid, disposed on the exposed surface of said organic polymeric composition;

b. removing a portion of the polysilicic acid and the organic polymeric composition to expose the aluminum base by subjecting the plate to a focused laser beam having an intensity sufficient to burn through the polysilicic acid and organic polymeric composition without substantially melting said aluminum base; and c. varying in a controlled manner, the point at which the laser beam impinges on said plate so that a predetermined pattern can be engraved on said plate.

* * * * *